US010955226B2

(12) United States Patent
Mohrmann et al.

(10) Patent No.: US 10,955,226 B2
(45) Date of Patent: Mar. 23, 2021

(54) HAND GRENADE FOR PRODUCING SMOKE

(71) Applicant: RHEINMETALL WAFFE MUNITION GMBH, Unterluess (DE)

(72) Inventors: Holger Mohrmann, Freiburg (DE); Wolfgang Schuetzenduebel, Ermsleben (DE); Christopher Zimmermann, Hamburg (DE)

(73) Assignee: RHEINMETALL WAFFE MUNITION GMBH, Unterluess (DE)

( * ) Notice: Subject to any disclaimer, the term of this patent is extended or adjusted under 35 U.S.C. 154(b) by 0 days.

(21) Appl. No.: 16/673,258

(22) Filed: Nov. 4, 2019

(65) Prior Publication Data

US 2020/0200515 A1 Jun. 25, 2020

Related U.S. Application Data

(63) Continuation of application No. PCT/EP2018/061386, filed on May 3, 2018.

(30) Foreign Application Priority Data

May 4, 2017 (DE) ..... 10 2017 109 617.5

(51) Int. Cl.
*F42B 12/48* (2006.01)
*F42B 27/00* (2006.01)

(52) U.S. Cl.
CPC ..... *F42B 12/48* (2013.01); *F42B 27/00* (2013.01)

(58) Field of Classification Search
CPC ..... F42B 12/48; F42B 12/46; F42B 12/36; F42B 5/155
See application file for complete search history.

(56) References Cited

U.S. PATENT DOCUMENTS 7,946,228 B2 5/2011 Dindl et al.
8,091,480 B2 * 1/2012 Lubbers ..... F42B 12/36 102/368
9,016,205 B2 4/2015 Lübbers et al.
9,103,638 B2 * 8/2015 Thomas ..... F42B 27/08
(Continued)

FOREIGN PATENT DOCUMENTS

DE 102008058776 A1 5/2010
DE 10 2010 052 210 A1 5/2012
WO WO2009137370 A2 11/2009

OTHER PUBLICATIONS

International Search Report dated Jul. 13, 2018 in corresponding application PCT/EP2018/061386.

*Primary Examiner* — J. Woodrow Eldred
(74) *Attorney, Agent, or Firm* — Muncy, Geissler, Olds & Lowe, P.C.

(57) ABSTRACT

A hand grenade for producing smoke, having a housing provided with outflow openings for the smoke to be produced. The hand grenade also has a fuse head having an igniter for igniting the hand grenade and an ignition and delay line. An active charge can be ignited via the fuse head and the ignition and delay line, creating a carrier gas in the housing. An effect region is also provided in the hand grenade, by means of which at least one effect module of the hand grenade can be supplied. The effect module contains an active ingredient that can be converted into its gaseous state of aggregation by the action of heat and can flow out of the outflow openings with the carrier gas.

12 Claims, 1 Drawing Sheet

(56) References Cited

U.S. PATENT DOCUMENTS

| | | | | |
|---|---|---|---|---|
| 9,448,047 | B1 | 9/2016 | Domanico | |
| 2015/0308801 | A1 | 10/2015 | Thomas | |
| 2017/0267602 | A1* | 9/2017 | Banish | C06D 7/00 |

* cited by examiner

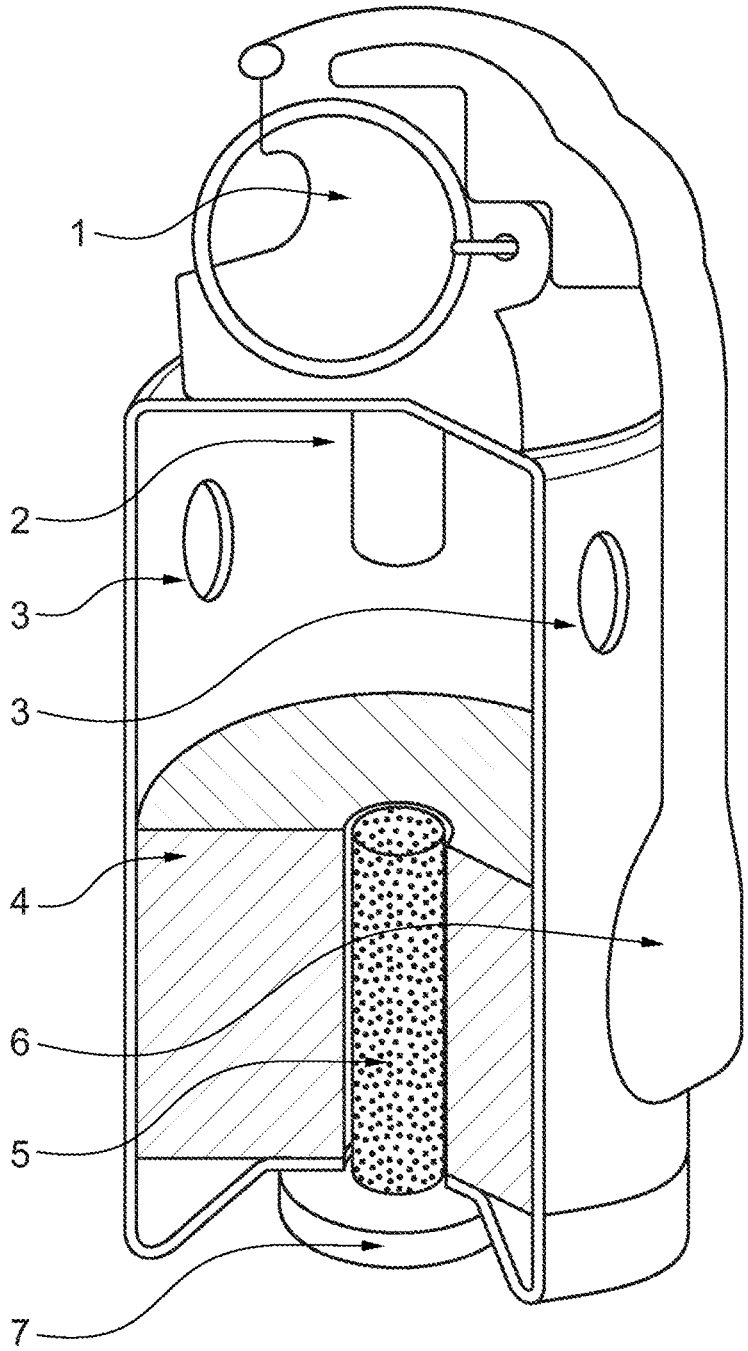
1
2
3
3
4
6
5
7

HAND GRENADE FOR PRODUCING SMOKE

This nonprovisional application is a continuation of International Application No. PCT/EP2018/061386, which was filed on May 3, 2018, and which claims priority to German Patent Application No. 10 2017 109 617.5, which was filed in Germany on May 4, 2017, and which are both herein incorporated by reference.

BACKGROUND OF THE INVENTION

Field of the Invention

The present invention relates to a hand grenade for producing smoke, in particular, for producing colored smoke.

Description of the Background Art

A corresponding smoke is frequently used in the military sector and for safety purposes, for example, as a simple form of remote communication. For example, it is possible to use it for target marking for attack and rescue operations. After being activated, the signal-smoke charges carried as hand grenades produce smoke of a certain kind, which is defined by the composition mixture contained within the smoke charge. The different kinds of smoke, for example, different colors, are made possible by different numbers of the various grenades.

Thereby, conventionally, it is necessary to carry as many grenades of a certain kind as are expected to be required.

In addition, in U.S. Pat. No. 9,448,047 B1, a grenade for producing colored smoke is described. Thereby, different color chambers are integrated into a hand grenade, which produce a smoke with the desired color out of the previously produced gas due to a changeable arrangement of said chambers with respect to one another and the flow arrangement resulting therefrom. The desired color can be adjusted accordingly. Depending on the desired color, the existing color chambers are flowed through or remain unused. This means that unused chemical substances remain at the place of deployment after using the grenades.

Within the scope of conducting modern combat, different kinds of smoke generators are crucial. Due to the abundance of equipment, the reduction of the weight to be carried by the user is however desired. It is also undesired to discard active charges or effect charges that are unused. In the aforementioned publication, the individually set color chambers are used and the unused color chambers are discarded. This means higher production and cost requirements since the unused color chambers are also provided with a corresponding charge.

SUMMARY OF THE INVENTION

It is therefore an object of the present invention to provide a hand grenade, which can produce different kinds of smoke depending on requirements and that no unused effect charges are discarded with the hand grenade according to the invention.

In an exemplary embodiment, a hand grenade is provided for producing smoke, having a housing which comprises outflow openings for the smoke to be produced. These outflow openings can be designed as holes in the housing, which can also be sealed with a diaphragm that is permeable on a single side.

Furthermore, the hand grenade can have a fuse head, which comprises a device, e.g. igniter, to ignite the hand grenade. The device to ignite the hand grenade can be mechanical in nature, such as a piezo element, or be electrical as well as chemical in nature. All devices to ignite the hand grenade have in common that they can initiate a pyrotechnic element.

An ignition and delay line is also assigned to the hand grenade, which can be initiated by the means to ignite the hand grenade. The ignition and delay line is intended to ignite or break down a corresponding active charge. Similarly, a time delay is assigned to the ignition and delay line so that, after initiating the ignition and delay line, this can ignite or break down an active charge with a time delay.

Such an active charge is also provided in the housing, which can be ignited and broken down via the ignition and delay line. By burning or breaking down the active charge, a carrier gas is created in the housing. If the pressure exerted by the carrier gas in the housing is high enough, this carrier gas is then led out of the hand grenade via the corresponding outflow openings.

The active charge can be introduced via a reservoir in the hand grenade and contains a pyrotechnic mixture. Preferably, this mixtures includes at least one oxidant and at least one reducing agent, which is used to generate the carrier gas and the required heat energy.

According to the invention, an effect region is provided in the housing, which can accommodate at least one effect module. Such an effect module contains an active ingredient, which is converted into its gaseous state of aggregation due to the action of heat. This action of heat is generated by burning or breaking down the active charge so that the then gaseous active ingredient of the effect module can flow out of the outflow openings with the carrier gas.

Due to this construction, it is possible to only equip the hand grenade according to the invention with the effect modules which are actually intended to be burned or broken down. Thereby, no effect agents are discarded in an unused state.

Favorably, due to the aforementioned construction, any effect module to be used can be burned or broken down with the same type of active charge. Thereby, only one active charge needs to be provided in the housing of the hand grenade in order to burn or break down the effect charges. The effect modules can thereby be produced separately from the active charge and be stored up until the time they are used. This makes space-saving storage of the effect modules possible.

The effect module can have a shell, which completely encloses the active ingredient of the effect module. Due to this design, it is possible to store the effect modules outside the hand grenade.

In an embodiment, the effect module comprises at least one organic active ingredient. This organic active ingredient is designed as a colorant in a particularly preferred embodiment. Thereby, it is made possible that the smoke produced by the hand grenade is output as colored smoke.

The igniter for igniting also comprise an actuator in an embodiment. The said actuator triggers the initiation of the fuse head upon its activation. The initiation can be caused by an electrical, chemical or mechanical effect. Thereby, the actuator itself can act on an electrical, mechanical or magnetic level. For this purpose, the actuator can be triggered manually or controlled remotely. In the case of remotely triggering the actuator, the hand grenade then comprises a corresponding receiver for receiving remote-control signals.

In an example, this is designed as a manual lever for manually operating the actuator. In the case of manually actuating the manual lever, the ignition process of the hand grenade starts, in which the fuse head is initially activated; then the latter initiates the ignition and delay line and, after the delay time has passed, the active charge is ignited and broken down via the ignition and delay line.

The active charge itself can comprise a pyrotechnic substance mixture, which can be burned and broken down with the development of heat. Due to the heat development then resulting, the effect module is heated accordingly so that this can flow out of the outflow openings together with the carrier gas after its conversion into the gaseous state of aggregation.

When using the shell around the effect charge, this is designed in such a way that the shell is at least partially destroyed by the heat development of the active charge or breaks due to the pressure of the effect charge when converting into the gaseous state of aggregation.

The hand grenade according to the invention can produce various types of smoke, preferably colored smoke. However, various densities of the smoke, various gray shades, all the way to smoke with infrared or UV components are also conceivable.

The effect module can comprise at least one organic substance in order to bring about the aforementioned effects. This can be, for example, designed as a colorant. It is also possible to mix a plurality of organic substances within an effect module in order to bring about a mixed effect for the smoke, for example, a yellow coloring with an infrared component.

Similarly, it is also possible to provide the hand grenade in such a way that a plurality of effect modules can be introduced into the effect region of the housing, which then together produce a mixture of the smoke. In this way, for example, two effect modules can be introduced, one for producing colored smoke and one for producing UV components within the smoke.

In order to introduce the effect modules into the effect region, the housing contains an opening, via which effect modules can be introduced into the effect region of the housing. This preferably occurs by sliding the effect modules into the housing of the hand grenade according to the invention.

In order to keep introduced effect modules within the effect region of the hand grenade, the opening can preferably be sealed with a closure. This closure can be an intrinsic component, which is attached after introducing the effect module into or at the opening in order to keep the effect module within the hand grenade. Similarly, it is also possible that the effect region comprises a thread and the effect module comprises a corresponding mating thread. In this case, the effect module can form the closure, namely with an end pointing toward the opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which are given by way of illustration only, and thus, are not limitive of the present invention, and wherein the sole FIGURE is a schematic illustration and cross section through a hand grenade according to an exemplary embodiment of the invention.

DETAILED DESCRIPTION

The FIGURE shows an exemplary embodiment of the hand grenade according to the invention for producing smoke. In addition, the hand grenade possesses a housing, which is shown as a cross section in the FIGURE in order to be able to show the features within the housing.

The housing comprises outflow openings 3 which are used to allow the smoke produced within the housing to exit toward the outside. The outflow openings 3 can be sealed using a diaphragm in order to make the output of smoke from the housing possible, however, thereby not allowing any fluid from the outside of the housing to enter the inside of it.

Furthermore, the hand grenade according to the invention comprises a fuse head 1, which comprises an igniter to ignite the hand grenade. The igniter for igniting furthermore comprise an actuator 6, which is designed as a manual lever in the present FIGURE, thereby acting on a mechanical level. The actuator is used to activate the fuse head 1. In the present case, this occurs by moving the manual lever.

The fuse head 1 initiates the activation of an ignition and delay line 2. This is preferably designed as a pyrotechnic composition, which has a certain burn duration, thereby causing the delay.

After the delay the burning of the ignition and delay line 2 has passed, this ignites an active charge 4, which is also arranged within the housing of the hand grenade. Due to the ignition, the active charge 4 is ignited, burned off and broken down, whereby a carrier gas results. The carrier gas then disperses inside the housing of the hand grenade.

An effect region is provided in the housing of the hand grenade, which can accommodate at least one effect module 5. This effect module 5 contains an active ingredient, which can be converted into its gaseous state of aggregation due to heat development. This action of heat is produced by the burning and breaking down of the active charge 4. After conversion into the gaseous state of aggregation, the active ingredient can then flow out of the outflow openings 3 together with the carrier gas.

The effect module 5 contains an active ingredient, preferably an organic active ingredient, which gives the produced smoke a certain feature, for example, a certain color. Thereby, the organic active ingredient can also be designed to be a colorant.

For better handling and for creating a storage possibility of the effect module 5, a shell can be provided, which completely encloses the active ingredient of the effect module 5.

According to the invention, the housing of the hand grenade possesses an opening, via which the effect module 5 can be introduced into the effect region of the housing. In a particular embodiment, in addition, the effect region of the housing is provided with a thread and the effect module is provided with a corresponding mating thread so that the effect module 5 can be screwed into the effect region of the housing.

The introduction of the effect module 5 is shown in FIG. 1 by the underside of the hand grenade.

In order to keep the effect module 5 within the effect region, a closure 7 is preferably provided, by means of which the opening can be sealed. This closure 7 can be designed as an intrinsic component, which is screwed into or onto the opening by the screw connection. Other closure possibilities for the closure 7 include a quick-release closure or a magnetic closure. Similarly, however, the closure 7 can also be formed out of the effect module 5, namely that an end of the effect module 5 preferably forms this closure after screwing in. This is the end of the effect module 5 which faces the opening. In this case, it is proposed to manufacture the effect module 5 with the same dimensions as the effect region in which it can be received. By means of this, a level sealing of the opening is ensured.

The present invention is not limited to the aforementioned features. On the contrary, further embodiments are possible. In this way, the outflow openings can be applied onto the base or the head of the hand grenade. Similarly, the ignition and delay line can be electrically designed so that no burning of this is caused, but the delay is electrically controlled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A hand grenade for producing smoke, the hand grenade comprising:

a housing that comprises outflow openings for the smoke to be produced;

a fuse head that comprises an igniter for igniting the hand grenade;

an ignition and delay line;

an active charge arranged within the housing, the active charge being adapted to be ignited via the ignition and delay line so that a carrier gas results by burning the active charge;

an effect region provided in the housing, the effect region configured to accommodate at least one effect module, wherein the effect module contains an active ingredient that is converted into a gaseous state of aggregation via heat and flows out of the outflow openings with the carrier gas, and wherein the active charge has a central opening extending axially therethrough, wherein the central opening forms the effect region, such that the effect module is accommodated inside the central opening of the active charge.

2. The hand grenade as claimed in claim 1, wherein the igniter for igniting comprise an actuator, which acts on an electrical, magnetic or mechanical level.

3. The hand grenade as claimed in claim 2, wherein the actuator is a manual lever.

4. The hand grenade as claimed in claim 1, wherein the outflow openings are arranged on a side of the housing.

5. The hand grenade as claimed in claim 1, wherein the active charge comprises a pyrotechnical substance mixture, which can burn off under the development of heat.

6. The hand grenade as claimed in claim 1, wherein the effect module comprises at least one organic active ingredient.

7. The hand grenade as claimed in claim 6, wherein the organic active ingredient is a colorant such that the hand grenade emits colored smoke.

8. The hand grenade as claimed in claim 1, wherein the effect module comprises a shell, which completely encloses the active ingredient of the effect module.

9. The hand grenade as claimed in claim 1, wherein the housing contains an effect module opening, via which the effect module is introduced into the effect region of the housing.

10. The hand grenade as claimed in claim 9, wherein the effect module opening is sealed via a closure.

11. The hand grenade as claimed in claim 9, wherein the effect region comprises a thread and the effect module comprises a corresponding mating thread.

12. The hand grenade as claimed in claim 10, wherein the closure is formed by an end of the effect module.

* * * * *